US009956779B2

(12) United States Patent
Mabuchi et al.

(10) Patent No.: US 9,956,779 B2
(45) Date of Patent: May 1, 2018

(54) LIQUID EJECTION HEAD AND METHOD FOR EJECTING LIQUIDS

(71) Applicants: CANON KABUSHIKI KAISHA, Tokyo (JP); Océ Printing Systems GmbH & Co. KG, Poing (DE)

(72) Inventors: Hidehisa Mabuchi, Kawasaki (JP); Yoshitomo Marumoto, Kawasaki (JP); Takayuki Ushiyama, Kawasaki (JP); Benno Petschik, Markt Schwaben (DE); Andreas Paul, Vaterstetten (DE)

(73) Assignees: Canon Kabushiki Kaisha, Tokyo (JP); Oce Printing Systems GmbH & Co. KG, Poing (DE)

( * ) Notice: Subject to any disclaimer, the term of this patent is extended or adjusted under 35 U.S.C. 154(b) by 12 days.

(21) Appl. No.: 14/971,262

(22) Filed: Dec. 16, 2015

(65) Prior Publication Data

US 2016/0176188 A1 Jun. 23, 2016

(30) Foreign Application Priority Data

Dec. 22, 2014 (JP) ..... 2014-258886

(51) Int. Cl.
*B41J 2/155* (2006.01)
*B41J 2/14* (2006.01)
*B41J 2/145* (2006.01)

(52) U.S. Cl.
CPC ..... *B41J 2/145* (2013.01); *B41J 2/14201* (2013.01); *B41J 2/155* (2013.01)

(58) Field of Classification Search
CPC ..... B41J 2/155; B41J 2/14201; B41J 2002/14306
See application file for complete search history.

(56) References Cited

U.S. PATENT DOCUMENTS 4,194,210 A 3/1980 Krause
6,779,871 B1 8/2004 Seto et al.
(Continued)

FOREIGN PATENT DOCUMENTS

EP 0 807 522 A2 11/1997
FR 2 346 154 A1 10/1977
(Continued)

OTHER PUBLICATIONS

Extended European Search Report dated Jun. 15, 2016, in European Patent Application No. 15201492.4.
(Continued)

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A liquid ejection head includes a first ejection opening group in which a plurality of ejection openings that eject a particular kind of liquid onto a print medium are arranged in a predetermined direction, and a second ejection opening group that is provided along the first ejection opening group to eject the particular kind of liquid onto the print medium. The first ejection opening group is provided upstream of the second ejection opening group with respect to a relative moving direction between the print head and the liquid ejection head. The plurality of ejection openings included in the first ejection opening group are disposed in the predetermined direction in a zigzag shape, and the liquid ejected from the ejection openings adjacent to each other in the predetermined direction come in contact with each other on the print medium.

11 Claims, 13 Drawing Sheets

(56) References Cited

U.S. PATENT DOCUMENTS

| | | | | |
|---|---|---|---|---|
| 2001/0026307 | A1 | 10/2001 | Akahira | |
| 2004/0041881 | A1 | 3/2004 | Okuda et al. | |
| 2005/0219287 | A1* | 10/2005 | Tatsumi | B41J 2/145 347/9 |
| 2005/0219296 | A1* | 10/2005 | Hirakawa | B41J 2/2132 347/15 |
| 2005/0219312 | A1* | 10/2005 | Oishi | B41J 2/14209 347/40 |
| 2007/0046735 | A1 | 3/2007 | Kodama | |
| 2007/0091139 | A1* | 4/2007 | Takatsuka | B41J 2/16511 347/29 |
| 2010/0194801 | A1* | 8/2010 | Hibi | B41J 2/155 347/9 |
| 2012/0162318 | A1 | 6/2012 | Muraoka et al. | |
| 2013/0063522 | A1 | 3/2013 | Arai et al. | |
| 2013/0083110 | A1* | 4/2013 | Sumiyoshi | B41J 11/008 347/14 |

FOREIGN PATENT DOCUMENTS

| | | | |
|---|---|---|---|
| JP | 2009-285921 | A | 12/2009 |
| WO | 2010/010804 | A1 | 1/2010 |

OTHER PUBLICATIONS

Extended European Search Report dated Apr. 27, 2017, in European Patent Application No. 16204220.4.

* cited by examiner

LIQUID EJECTION HEAD AND METHOD FOR EJECTING LIQUIDS

BACKGROUND OF THE INVENTION

Field of the Invention

The present invention relates to a liquid ejection head that ejects liquids such as ink, a liquid ejecting apparatus, and a method for ejecting liquids.

Description of the Related Art

In recent years, there is an increasing demand for a consumer application, in addition thereto, a business application by higher print speeds and an industrial application in regard to the inkjet technologies that eject liquids such as ink. For improving the print speed in such a liquid ejecting apparatus, a so-called full line type liquid ejection head that is configured to cause ejection openings of a liquid ejection head to correspond to a width of a print medium is preferable. For performing ejection in high landing position density of liquid droplets by such a full line type liquid ejection head, it is desirable to increase the arrangement density of the ejection openings formed in the liquid ejection head.

Japanese patent Laid-Open No. 2009-285921 is known as the configuration of such a full line type liquid ejection head that can perform a print in high density. FIG. 5 shows a part of the configuration of the liquid ejection head disclosed in Japanese patent Laid-Open No. 2009-285921. As shown in FIG. 5, a liquid ejection head 2 is provided with four ejection opening groups 121-*a* to 121-*d*. Ejection openings of each ejection opening group are arranged in a matrix on an ejection opening surface of the liquid ejection head, and positional relations between ejection opening groups are appropriately determined, thus enabling the liquid ejection head to perform printing in high density.

However, with the arrangement of the ejection openings in the liquid ejection head disclosed in Japanese patent Laid-Open No. 2009-285921, a variation in a time difference between a landing time when a liquid droplet ejected from an ejection opening lands on a print medium and a landing time when a liquid droplet ejected from the adjacent ejection opening lands on the print medium is large. As a result, there are some cases where streaks are generated in an image printed with this arrangement. Hereinafter, the mechanism of the streak generation will be explained.

For example, in a case of printing one line in a direction crossing a conveying direction of a print medium in the ejection opening arrangement having a two-dimensional structure as shown in FIG. 5, landing times of the liquid droplets, which form dots on the one line and are ejected to the print medium from the respective ejection openings, differ from each other. For this reason, a time difference between a landing time of a liquid droplet forming a certain dot and landing time of liquid droplets forming dots adjacent to one side and the other side of the certain dots differs. FIG. 12 is a graph showing an arrangement of an ejection opening and a variation in distance of the adjacent ejection opening. In FIG. 12, a position of an ejection opening on the ejection opening surface in the liquid ejection head is indicated at a black diamond shape, and a distance of the adjacent ejection opening is indicated at a black square shape. In this way, the time when the liquid droplet lands on the print medium varies due to the variation in distance between the ejection opening and the adjacent ejection opening. As a result, generating streaks caused by the liquid droplet phenomenon occur on the print medium as shown in FIG. 7. More specifically, first, a liquid droplet 130 lands on a print medium 135, a liquid droplet 131 lands thereon adjacent to the liquid droplet 130 1 msec later, and a liquid droplet 132 lands thereon adjacent to the liquid droplet 131 3 msec later. Thereafter, a liquid droplet 133 lands on the print medium after a relatively long time interval of 10 msec, but the three liquid droplets that have landed previously are contracted due to surface tension to be formed as a liquid droplet 134 having a smaller diameter. In this way, even if the liquid droplet 133 lands on the print medium adjacent to the contracted liquid droplet 134, a gap is generated between the liquid droplets without the liquid droplets coming in contact with each other, and the gap is visible as a streak on the image. This phenomenon tends to be easily generated particularly on a print medium having low absorption.

SUMMARY OF THE INVENTION

The present invention provides a liquid ejection head in which ejection openings are arranged in high density, and a liquid ejecting method which can suppress generation of streaks due to a variation in a time difference of liquid droplets landing adjacent to each other on a print medium.

The present invention in its first aspect provides a liquid ejection head comprising: a first ejection opening group in which a plurality of ejection openings that eject a first kind of liquid onto a print medium are arranged in a first direction; and a second ejection opening group that is provided along the first ejection opening group to eject the first kind of liquid onto the print medium, wherein the first ejection opening group is provided upstream of the second ejection opening group in a relative moving direction between the print medium and the liquid ejection head, and the plurality of ejection openings included in the first ejection opening group are disposed in the first direction in a zigzag shape.

The present invention in its second aspect provides a liquid ejection head comprising: a plurality of liquid chambers each with an activation element for generating a droplet ejected through an ejection opening, an ejection opening plane with at least two ejection opening groups with a plurality of ejection openings ejecting droplets onto a print medium, whereby said groups are arranged in the ejection opening plane across the print medium conveying direction and wherein the ejection opening groups are arranged side by side in the ejection opening plane, the plurality of ejection openings of at least one ejection opening group are arranged in a zigzag shape, and the plurality of ejection openings of the further ejection opening groups are arranged in such a staggered manner that time lags of landing times of adjacent droplets landing on the print medium for all droplets forming a printed line across the print medium conveying direction get minimized.

The present invention in its third aspect provides a method for ejecting liquids with a liquid ejection head, comprising: a first step for preparing a liquid ejection head including a first ejection opening group in which a plurality of ejection openings that eject a first kind of liquid are arranged in a first direction in a zigzag shape, and a second ejection opening group in which a plurality of ejection openings that eject the first kind of liquid are arranged in parallel to the first ejection opening group; a second step for ejecting liquid from a first ejection opening included in the first ejection opening group to form a first dot on a print medium; a third step for ejecting liquid from a second ejection opening that is included in the first ejection opening group and is adjacent to the first ejection opening in the first direction to form a second dot in such a manner as to come in contact with the first dot on the print medium; a fourth step for ejecting liquid from a third ejection opening that is included in the first ejection opening group and is adjacent to the second ejection opening at the opposite side to the first ejection opening in the first direction to form a third dot in such a manner as to come in contact with the second dot on the print medium; and a fifth step for ejecting liquid from a fourth ejection opening included in the second ejection opening group to form a fourth dot in such a manner as to come in contact with at least one of the first dot, the second dot and the third dot on the print medium.

According to the above arrangement, it is possible to provide a liquid ejection head, and a liquid ejecting apparatus which can suppress generation of a streak by bias of the liquid due to the variation in a time difference of liquid droplets landing adjacent to each other on a print medium, and can perform a print in high density.

Further features of the present invention will become apparent from the following description of exemplary embodiments (with reference to the attached drawings).

DESCRIPTION OF THE EMBODIMENTS

Hereinafter, embodiments of the present invention will be explained.

(Apparatus Configuration)

Figure 1:
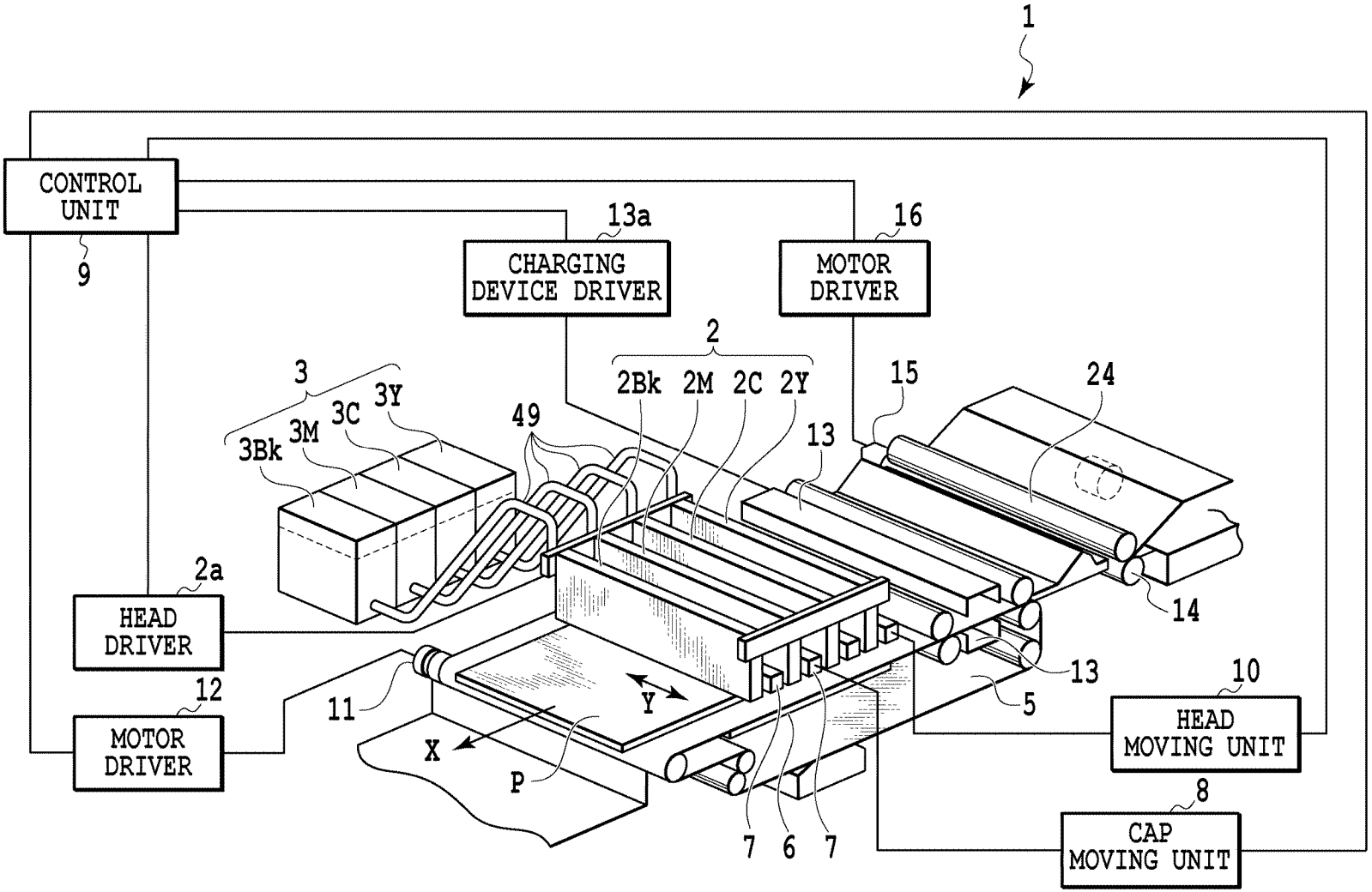
FIG. 1 is a view showing an inkjet liquid ejecting apparatus according to an embodiment of the present invention.
Figure 2:
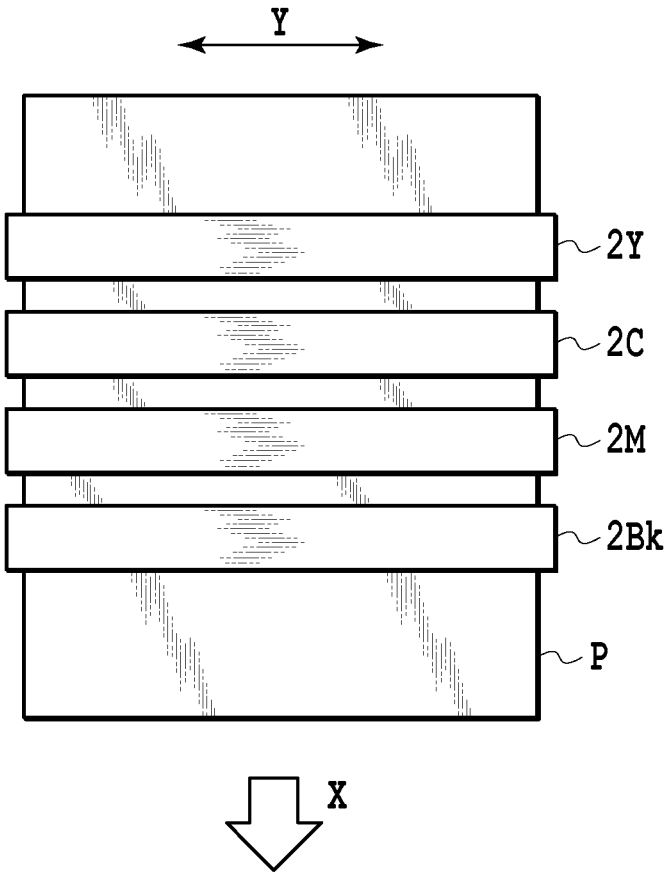
FIG. 2 is a top view showing an example of the arrangement of liquid ejection heads according to the embodiment of the present invention.

FIG. 1 is a diagram showing an example of the configuration of an inkjet apparatus (hereinafter, referred to as "liquid ejecting apparatus") 1 that is a liquid ejecting apparatus for ejecting liquids such as ink, according to an embodiment of the present invention. The liquid ejecting apparatus 1 is provided with a so-called full line type liquid ejection head 2 having a print width in accordance with a width of a print medium. The liquid ejection head 2 comprises a plurality of liquid ejection heads corresponding to the respective colors (2Y, 2M, 2C, and 2Bk). Specifically the liquid ejection head 2 includes a liquid ejection head 2Y for ejecting yellow ink, a liquid ejection head 2M for ejecting magenta ink, a liquid ejection head 2C for ejecting cyan ink, and a liquid ejection head 2Bk for ejecting black ink. These liquid ejection heads are respectively disposed in parallel in a conveying direction (X direction) of a print medium as shown in FIG. 2, and ejection openings provided in each of the liquid ejection heads are arranged in a direction (Y direction) crossing the X direction. The liquid ejection heads 2 each are connected to four ink tanks 3Y, 3M, 3C and 3Bk (hereinafter, referred to as "ink tank 3" collectively) that therein reserve yellow ink, magenta ink, cyan ink and black ink respectively through connecting pipes 49. The ink tanks 3 each can be removed independently.

The liquid ejection head 2 is provided in a position facing a platen 6, disposing a conveying belt 5 for conveying a print medium P therebetween. The liquid ejection head 2 ascends and descends in the direction facing the platen 6 by control of a head moving unit 10. It should be noted that an operation of the head moving unit 10 is controlled by a control unit 9. In addition, as described later in FIG. 6, FIG. 8 and the like, the liquid ejection head 2 is provided with ejection openings for ejecting liquids such as ink, a common liquid chamber to which ink in the ink tank 3 is supplied, and ink flow passages for introducing ink to the respective ejection openings from the common liquid chamber. An energy generating element that generates energy used for ejecting liquids, for example, a piezo-electric element made of a piezoelectric material is provided to correspond to each ejection opening. The piezo-electric element is connected electrically to the control unit 9 through a head driver 2*a*, and the piezo-electric element is deformed in response to an on/off signal (ejection/non-ejection signal) transmitted from the control unit 9 to control a drive and stop thereof, thus ejecting ink droplets from the ejection opening. It should be noted that in regard to the method for ejecting ink, various inkjet methods such as a method using a heater such as a heat element, a method using an electrostatic element, and a method using an MEMS element in addition to the method using the piezo-electric element may be adopted.

Caps 7 for executing recovery processing of the liquid ejection heads 2 are disposed in lateral sides of the liquid ejection heads 2. An operation of a cap moving unit 8 is controlled by the control unit 9 to move the cap 7 right under the liquid ejection head 2, causing the cap 7 to receive waste ink discharged from the ejection opening.

The conveying belt 5 that is a part of a conveying unit conveys the print medium P for performing a relative movement between the liquid ejection head 2 and the print medium P, and bridges over between drive rollers connected to a belt drive motor 11. An operation of the conveying belt 5 is switched by a motor driver 16. A charging device 13 is provided in the upstream side of the conveying belt 5. The charging device 13 charges the conveying belt 5 to cause the print medium P to make close contact with the conveying belt 5. Thereby the print medium is conveyed in a conveying direction X. The charging device 13 switches on/off by means of a charging device driver 13*a*. A pair of feeding rollers 14 supplies the print medium P onto the conveying belt 5. A feeding motor 15 rotates the pair of feeding rollers 14. The feeding motor 15 is controlled by the motor driver 16.

The above explanation is made of one example of the configuration of the liquid ejecting apparatus 1. It should be noted that the configuration of the liquid ejecting apparatus 1 shown in FIG. 1 is absolutely one example, and the present invention is not necessarily limited to this configuration. For example, the liquid ejecting apparatus 1 shown in FIG. 1 is configured such that the print medium P is conveyed relative to the liquid ejection head 2, but a relative movement between the liquid ejection head 2 and the print medium P is only one option, and therefore the configuration is not limited to this option. For example, the liquid ejection head 2 may be moved relative to the print medium P. Herein after a direction of this relative movement is called a relative movement direction. The print medium P may be a belt like continuous form paper or a cut paper passing under the liquid ejection head in direction X.

Figure 3:
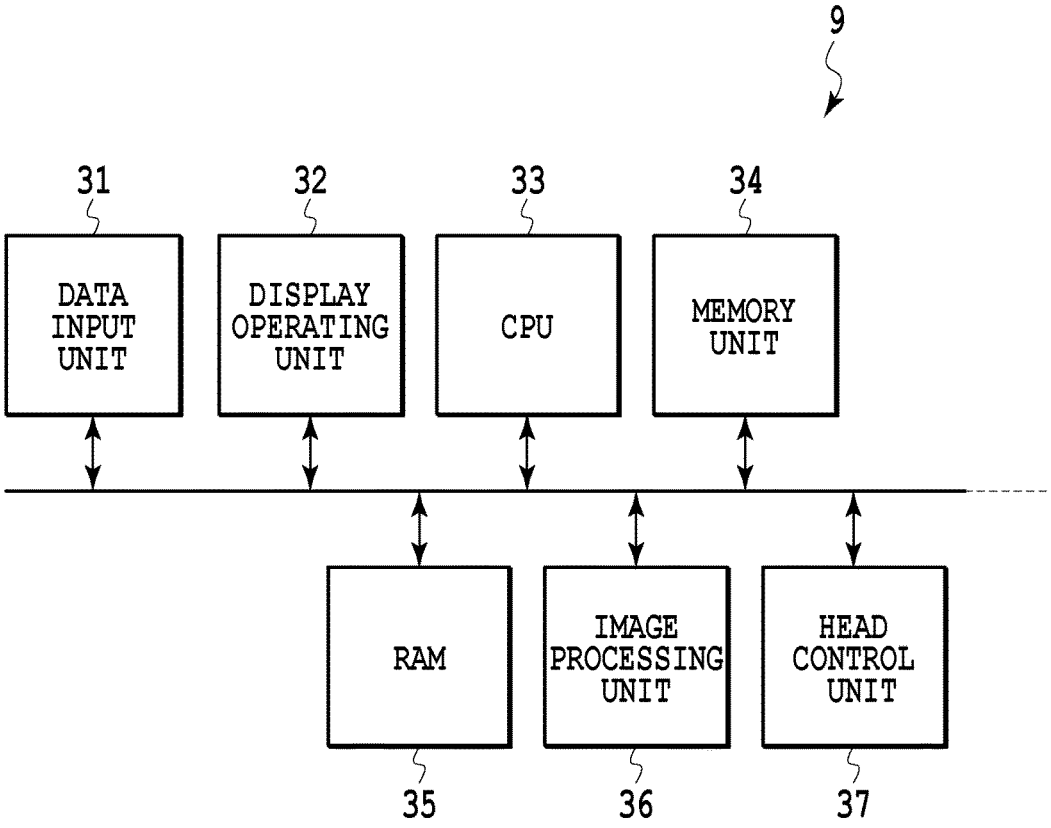
FIG. 3 is a block diagram showing an example of a control unit in the liquid ejecting apparatus according to the embodiment of the present invention.

FIG. 3 shows an example of the configuration of the control unit 9 shown in FIG. 1. The control unit 9 is provided with a data input unit 31, a display operating unit 32, a CPU 33, a memory unit 34, a RAM 35, an image processing unit 36 and a head control unit 37, as the functional configuration. Multi-valued image data is input to the data input unit 31 from image input equipment (for example, a digital camera or personal computer). The RAM 35 is used as a work area at the time of controlling various kinds of programs by the CPU 33, and temporally stores various kinds of calculation results, image processing results and the like. The display operating unit 32 includes an operating unit (for example, a touch panel or button) that inputs user instructions (for example, a setting instruction of a parameter or an instruction of a print start) into the apparatus, and a display unit (for example, a touch panel or display) for displaying various kinds of information to users. The CPU 33 integrally controls the operations of an entire apparatus. For example, the CPU 33 controls the operation of each unit according to the program stored in the memory unit 34. The memory unit 34 stores various kinds of data. The memory unit 34 stores therein, for example, information in regard to the kind of a print medium, information in regard to ink, information in regard to environments such as temperature and humidity, information (registration adjustment information) in regard to correction of an ink landing position, information in regard to the liquid ejection head 2, various kinds of control programs, and the like.

The image processing unit 36 executes image processing to multi-valued image data that is input from the data input unit 31. For example, the image processing unit 36 quantizes the multi-valued image data to image data of an N-value for each pixel, and assigns a dot arrangement pattern corresponding to a gradation value "K" indicated by each quantized pixel. Specifically in a case of the multi-valued image data expressed by 256 gradations, the gradation value is converted into the K-value. It should be noted that a multi-valued error diffusion method or any intermediate gradation processing method such as an average density preserving method and a dither matrix method may be used for this processing. Thereby the image processing unit 36 produces ejection data corresponding to each ejection opening. At the time of production of this ejection data, the ink landing position onto the print medium is adjusted based upon the registration adjustment information stored in the memory unit 34. The head control unit 37 controls a print operation by the liquid ejection head 2. The above explanation is made of one example of the configuration of the control unit 9. It should be noted that the control unit 9 is not necessarily limited to this configuration. For example, a part of this configuration may be executed by causing the CPU 33 to read in programs stored in the memory unit 34 by using the RAM 35 as a work area for execution or may be executed by a hardware configuration such as an exclusive circuit.

<Configuration of Liquid Ejection Head>

Figure 4:
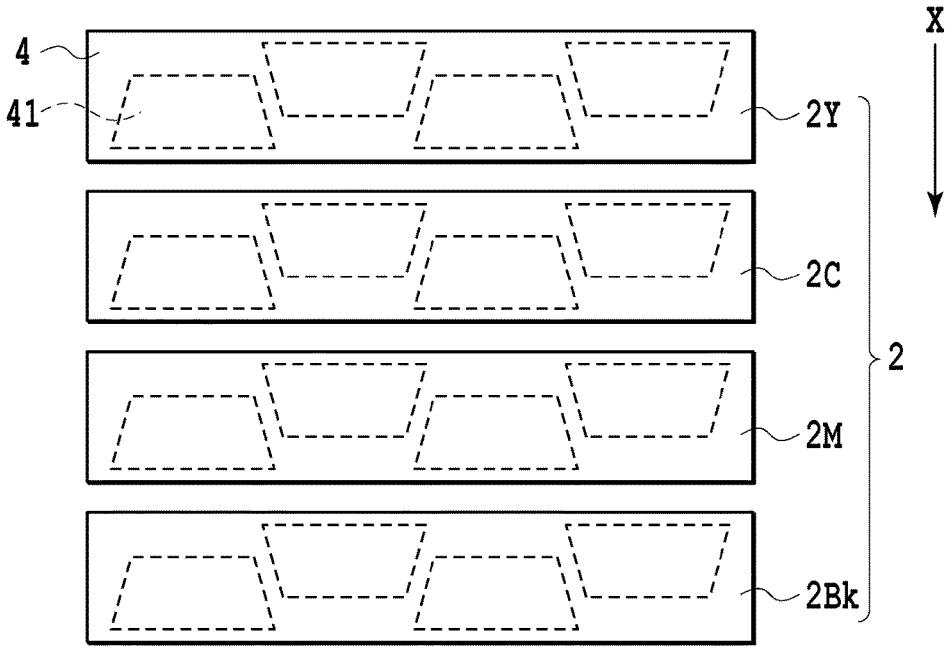
FIG. 4 is a view showing the configuration of an ejection opening surface of the liquid ejection head according to the embodiment of the present invention.
Figure 5:
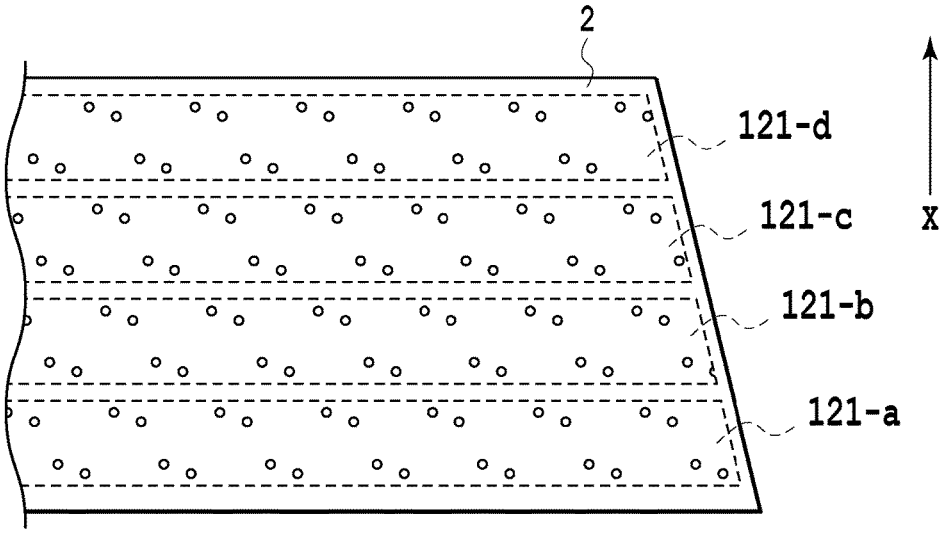
FIG. 5 is a view showing the configuration of a conventional ejection opening plate of a liquid ejection head.
Figure 8:
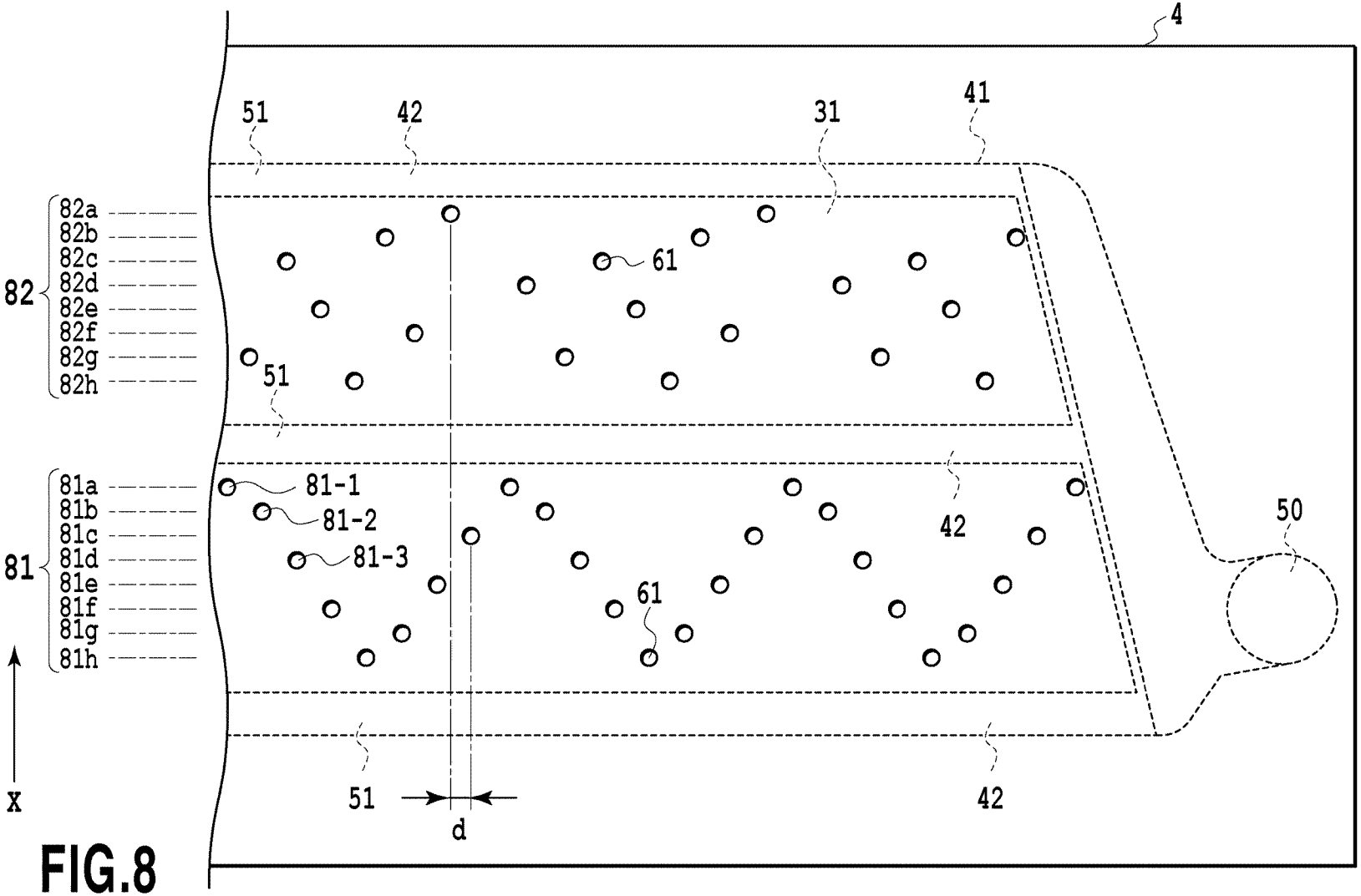
FIG. 8 is a diagram showing the arrangement of ejection openings according to the embodiment of the present invention.

Next, an explanation will made of the liquid ejection head 2 according to the present invention with reference to FIG. 4 and FIG. 8. FIG. 4 is a plan view of the liquid ejection head 2 showing an ink ejection surface, and shows the ejection opening surface on which ejection openings are formed. As shown in FIG. 4, each of the liquid ejection heads 2 is composed of an elongate flow passage member 4. More specifically, in the flow passage member 4, ejection opening areas (piezoelectric actuator unit areas) 41 are formed and the ejection opening areas are arranged in a longitudinal direction (a direction substantially perpendicular to the conveying direction) of the liquid ejection head 2 in a line. The ejection opening area 41 represents one unit of an ejection opening group for printing one line in the longitudinal direction of the liquid ejection head, and inks are ejected from the ejection openings included in one ejection opening area at timings according to positions of the ejection openings in the conveying direction and thereby the one line in the longitudinal direction is printed on the conveyed print medium. A plurality of ejection openings are arranged in each of the ejection opening areas, but are not shown in FIG. 4 for simplification. The detailed arrangement of the ejection openings will be described later in FIG. 8 and the like. The ejection opening areas are provided on the flow passage member 4 such that a pair of opposing sides (upper base and lower base) of the trapezoidal of the ejection opening area 41 are in parallel in the longitudinal direction of the liquid ejection head 2. In addition, the two ejection opening areas 41 respectively along each of two virtual straight lines in parallel in the longitudinal direction of the liquid ejection head 2, that is, a total of four ejection opening areas 41 are arranged on the flow passage member 4 in a zigzag shape as a whole. Oblique sides of the adjacent ejection opening areas 41 on the flow passage member 4 partly overlap with each other in the short direction of the liquid ejection head 2 (the conveying direction X). In a region for printing under the overlapped section by driving the two piezoelectric actuator units 41, liquid droplets ejected from the two ejection opening areas are mixed for landing on a print medium. A flow passage for supplying ink to an energy generating element formed in each of the ejection opening areas 41 is formed in the flow passage member 4 on which the ejection opening areas 41 are formed.

FIG. 8 is an enlarged diagram showing one of the ejection opening areas 41 formed on the flow passage member 4. Manifold 51 as a part of a common liquid flow passage 42, which is common to four ejection opening areas provided along the longitudinal direction of the flow passage member, is formed inside the flow passage member 4. The manifold 51 extends along the longitudinal direction of the flow passage member 4 to form an elongated shape. The liquid (ink) is supplied to the manifold 51 through an introduction opening 50 from the ink tank 3. The manifold 51 is branched into a plurality of sections inside the flow passage member 4. The manifold 51 is formed to extend along the oblique side of the ejection opening area 41 on the introduction opening 50 side. Further, the manifold 51 extending in the longitudinal direction includes two manifolds extending along both sides of and one manifold extending through a middle of each of the ejection opening areas 41. It should be noted that on an opposite end portion to an end portion of the flow passage member 4 on which the introduction opening 50 is provided, a discharge opening (not shown) is provided and thereby ink circulation can be performed between the liquid ejection head and the corresponding ink tank. Ink is supplied from the manifold 51 to a pressure chamber 53 (see FIG. 6) operated by the piezo-electric element, and thus the operation of the pressure chamber allows the ink to be ejected from a corresponding ejection opening 61 (see FIG. 6). It should be noted that the present invention may be applied to a liquid ejection head having a non-circulation arrangement which does not have both the introduction opening 50 and the discharge opening.

Figure 6:
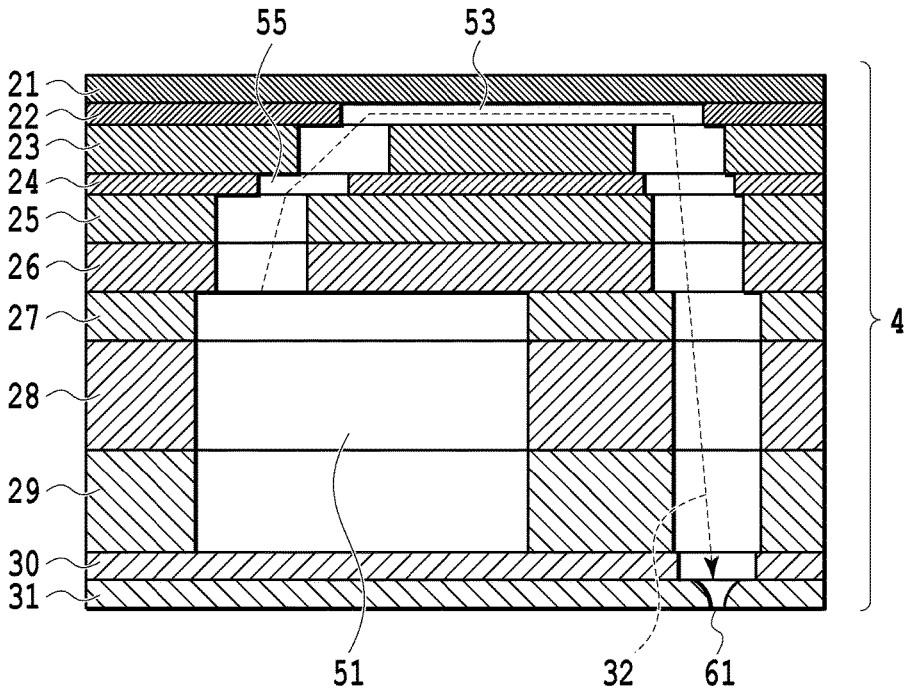
FIG. 6 is across section showing the liquid ejection head according to the embodiment of the present invention.

As shown in FIG. 6, the pressure chamber 53 is a hollow area having a planar shape. The pressure chambers 53 are formed to open on an upper surface of the flow passage member 4. These pressure chambers 53 are arranged over an entire surface of the region facing the ejection opening areas 41 on the upper surface of the flow passage member 4. In addition, an opening of each of the pressure chambers 53 is closed by causing the ejection opening areas 41 to adhere to the upper surface of the flow passage member 4.

<Section Structure of Liquid Ejection Head>

Next, a sectional structure of the ejection opening area 41, which is formed in the flow passage member 4, in the vicinity region of the ejection opening 61 will be explained with reference to FIG. 6. As shown in FIG. 6, the ejection opening 61 is communicated with the manifold 51 through the pressure chamber 53 and an aperture 55. An individual ink flow passage 32 is formed in a head body for each pressure chamber 53 from an exit of the manifold 51 to the ejection opening 61 via the aperture 55 and the pressure chamber 53. The liquid ejection head has a laminating structure in which a total of 10 sheet materials composed of an actuator unit 21, a cavity plate 22, a base plate 23, an aperture plate 24, a supply plate 25, manifold plates 26, 27, 28, a cover plate 29 and an ejection opening plate 30 are laminated in that order from above. The flow passage member 4 is configured of nine metallic plates by eliminating the actuator unit 21 from these 10 plates.

The actuator unit 21 is composed of a piezoelectric sheet on an upper layer portion on which an electrode is disposed, and this layer portion is deformed in a parallel direction (pressure chamber side) to the ejection opening direction at the time electric field is impressed. Therefore a volume of the pressure chamber 53 is reduced to increase a pressure of ink, thus ejecting ink droplets from the ejection opening 61. Thereafter when the electric field is returned to the previous state, the piezoelectric sheet is back to the original shape and the volume of the pressure chamber 53 is back to the original volume. Therefore the ink is sucked in from the manifold 51. The cavity plate 22 is a metallic plate provided with many openings to oppose the pressure chambers 53. The base plate 23 is a metallic plate in which in regard to the one pressure chamber 53 of the cavity plate 22, a communication hole between the pressure chamber 53 and the aperture 55 and a communication hole from the pressure chamber 53 to the ejection opening 61 are provided.

The supply plate 25 is a metallic plate in which in regard to the one pressure chamber 53 of the cavity plate 22, a communication hole between the aperture 55 and a sub manifold 5*a* and a communication hole from the pressure chamber 53 to the ejection opening 61 are provided. The manifold plates 26, 27, 28 are metallic plates that are jointed to each other at the laminating to form holes configuring the manifold 51, and further, are respectively provided with communication holes from the pressure chamber 53 to the ejection opening 61 in regard to the one pressure chamber 53 of the cavity plate 22. The cover plate 29 is a metallic plate in which in regard to the one pressure chamber 53 of the cavity plate 22, a communication hole from the pressure chamber 53 to the ejection opening 61 is provided. The ejection opening plate 30 is a metallic plate in which in regard to the one pressure chamber 53 of the cavity plate 22, the ejection opening 61 is provided.

These nine metallic plates are aligned to each other to be laminated such that the individual ink flow passages 52 are formed. The individual ink flow passage 52 first extends from the manifold 51 to the upper side, extends horizontally in the aperture 55, then extends further to the upper side, and again extends horizontally in the pressure chamber 53. After that, the individual ink flow passage 52 extends obliquely downward in a direction away from the aperture 55 for a little while, and then vertically downward to the ejection opening 61. The actuator unit 21 is deformed in response to transmission of a signal from the liquid ejection head control unit 37 to eject ink. An ink amount capable of being ejected differs depending on a deformation amount of the actuator unit 21, and in the present embodiment, ink droplet of 5 pl, 7 pl or 12 pl can be ejected.

<Ejection Opening Arrangement>

First Embodiment

Next, the arrangement of the ejection openings in the liquid ejection head will be in detail explained. FIG. 8 is a schematic diagram showing the ejection opening surface on which the ejection openings of the liquid ejection head 2 are formed. Ejection opening groups 81, 82 are arranged in the liquid ejection head 2 at both sides of the common liquid flow passage 42 (manifold 51) extending through the middle of the ejection opening area 41. In a case where the advancing direction X of the print medium is set from lower to upper, ejection is performed first from the ejection opening group 81 (first ejection opening group), and after that, ejection is performed from the ejection opening group 82 (second ejection opening group). In the ejection opening groups 81, 82, the ejection openings 61 are formed at a substantially equal interval "d" in the longitudinal direction of the liquid ejection head (first direction), and the ejection openings 61 are arranged to be shifted in such a manner as not to overlap in a direction perpendicular to the longitudinal direction between the ejection opening groups 81, 82. The ejection opening group 81 comprises eight ejection opening lines in a direction perpendicular to the longitudinal direction, each having ejection openings in a line in the longitudinal direction. The ejection opening group 82 is also provided with eight ejection opening lines, and a sum of the ejection opening group 81 and the ejection opening group 82 comes to 16 ejection opening lines. In the present embodiment, each of the ejection opening groups is provided with the ejection openings 61 arranged at 600 dpi in the longitudinal direction, and it is possible to form an image at resolution of 1200 dpi by the total of the ejection opening groups 81, 82. That is, the ejection opening interval "d" in the present embodiment is 21.1 μm. The ejection openings included in the ejection opening group 81 are arranged at an interval of 42.3 μm in the longitudinal direction of the liquid ejection head. In the present embodiment, as described later, among ejection openings included in the ejection opening group 81, liquids ejected from adjacent ejection openings in the longitudinal direction contact with each other on the print medium. Therefore, it is preferable that the liquid of 5 pl or more is ejected from the ejection openings included in the ejection opening group 81 and the adjacent ejection openings are arranged at an interval of 42.3 μm or less.

Figure 7:
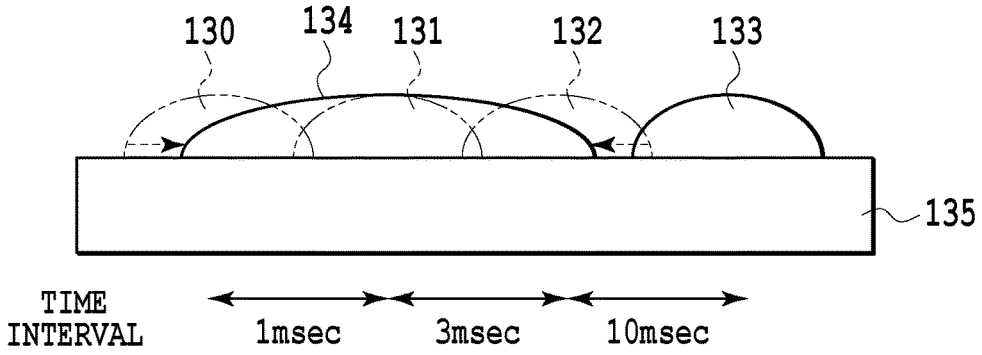
FIG. 7 shows a generation mechanism of a streak.

In the present embodiment, in a case of printing in this arrangement position of the ejection openings 61, one line in the longitudinal direction can be formed by using the ejection opening group 81 alone. That is, in a case of printing with the ejection openings 61 included in the ejection opening group 81, an ejection opening interval or an ejection amount to be ejected is set such that the adjacent liquid droplets come in contact with each other. The liquid droplets from the adjacent ejection openings in the longitudinal direction included in the ejection opening group 81 are only required to come in contact with each other, which can suppress generation of the streak as described in FIG. 7. In the present embodiment, the ejection opening 61 included in the ejection opening group 82 is provided to be shifted from the ejection opening 61 included in the ejection opening group 81 by a half pitch. The liquid droplet to be ejected from the ejection opening group 82 is adapted to come in contact with the dot formed by the first ejection opening group 81 on the print medium. Thereby the streak can be suppressed to perform the printing at a high resolution. In the present embodiment, the ejection opening 61 in the ejection opening group 81 and the ejection opening 61 in the ejection opening group 82 are shifted from each other by an interval "d" to enable the printing of 1200 dpi, but the shift is not necessarily required, and the ejection openings 61 in the ejection opening group 81 and the ejection opening group 82 may be provided in the same position in the longitudinal direction.

Next, the arrangement of each of the ejection opening groups in the short direction (second direction) in a case of 1200 dpi will be hereinafter explained. A distance in the short direction between an ejection opening 81-1 and the adjacent ejection opening 81-2 included in the ejection opening group 81 is set such that a time taken for printing one line is a predetermined value or less. Herein the time of the predetermined value or less differs depending upon a conveying speed of a print medium, and in a case of conveying a roll-shaped print medium at a conveying speed L of (0.83 m/s), it is preferable that the maximum value T (ms) of the time of the adjacent liquid droplets is approximately 1 ms. That is, it is preferable that the maximum value T (ms) of the time of the liquid droplet=100/83×L. The adjacent ejection opening is arranged in the short direction such that the time of the liquid droplet is below that time. In a case of the conveying speed of 0.83 m/s, the adjacent ejection opening is arranged in a position away by a distance of 1 ms×0.83 m/s=0.83 mm in the short direction. As similar to the next ejection opening 81-2, the time when the adjacent ejection opening 81-3 prints one line is made to be a predetermined time or less. Therefore the ejection openings 61 included in the ejection opening group 81 are arranged in a W-letter shape (zigzag shape). In this way, it is preferable that the time difference when the liquid ejected from the adjacent ejection opening lands on the print medium is substantially equal, but a slight time difference may be permitted depending upon physical properties of ink or characteristics of a print medium. As described above, the previously landed liquid droplet starts to be contracted with time, but a later ejection is to be performed with a time difference to cause a later liquid droplet ejected from the adjacent ejection opening to come in contact with the previous liquid droplet.

Figure 13:
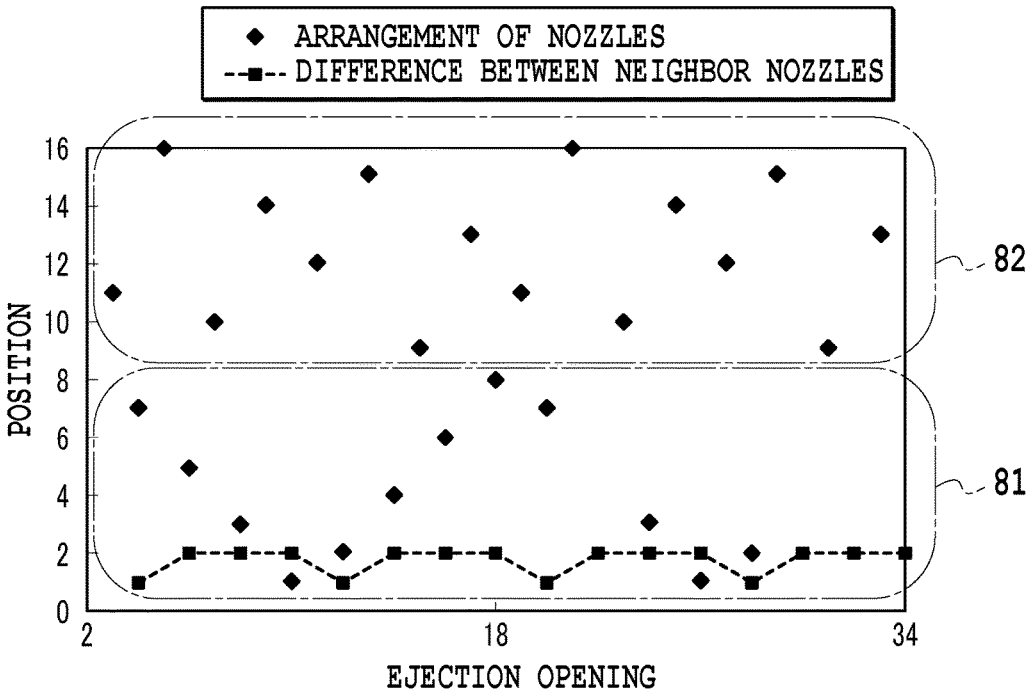
FIG. 13 is a diagram showing a time difference between an ejection opening and an ejection opening adjacent thereto according to the embodiment of the present invention.

FIG. 13 is a graph showing the arrangement of ejection openings and a variation in distance of an ejection opening to the adjacent ejection opening in the former ejection opening group. By thus arranging the ejection openings, variations in time when the liquid droplet ejected from the adjacent ejection opening lands on the print medium are reduced, and before the liquid droplet landed on the print medium starts to be contracted by sticking to the previously landed liquid droplet, another liquid droplet lands on the print medium opposite to the previously landed liquid droplet to cause the liquid droplets to come in contact with each other. Therefore, both sides of the liquid droplet are pulled with each other, and as a result, the contraction force of the previously landed liquid droplet is cancelled out. Such an operation can reduce the bias of the liquid droplets to suppress generation of the streak. In this way, the ejection opening group 81 can reduce the bias of the ink printed in the former part of the printing, and when the print medium is substantially filled with the liquid droplets, even if the liquid droplet printed by the ejection opening group 82 in the later part of the printing varies in landing time, the bias of the liquid droplet is not generated. Therefore, a degree of freedom of the ejection opening arrangement of the ejection opening group 82 for printing in the later part of the printing is high, and, for example, the ejection opening arrangement in a line in the longitudinal direction may be permitted. Considering a degree of freedom of the structure in the actuator, it is preferable that the ejection openings are arranged with appropriate variations. Since generation of the streak is reduced and the structural problem is reduced by doing so, it is possible to print in high density without largely increasing a size of the liquid ejection head. It should be noted that other ejection opening areas 41 have relationships of ejection opening groups. Further, ejection timings between the ejection opening areas are determined according to difference in positions of the ejection opening areas in the conveying direction so that one line in the longitudinal direction can be printed by the whole of the liquid ejection head 2.

Second Embodiment

Hereinafter, an explanation will be made of a second embodiment. In a case of performing drawing formation using a liquid ejection head of an inkjet method, a landing position of a liquid droplet ejected on a print medium is possibly shifted in the longitudinal direction. In general such a shift of the landing position is an inherent phenomenon of each ejection opening, and in a case of performing a sequential draw using this ejection opening, the shift of the landing position tends to be easily generated sequentially. Therefore, since the bias of the liquid is sequentially generated, the streak tends to be easily generated. Therefore, in the second embodiment, in ejection openings included in an ejection opening group 92 for ejecting later in addition to ejection openings included in an ejection opening group 91 for ejecting previously, the arrangement of ejection openings is made to be similar to that (zigzag shape) of the ejection openings in the ejection opening group 81 of the first embodiment.

Figure 9:
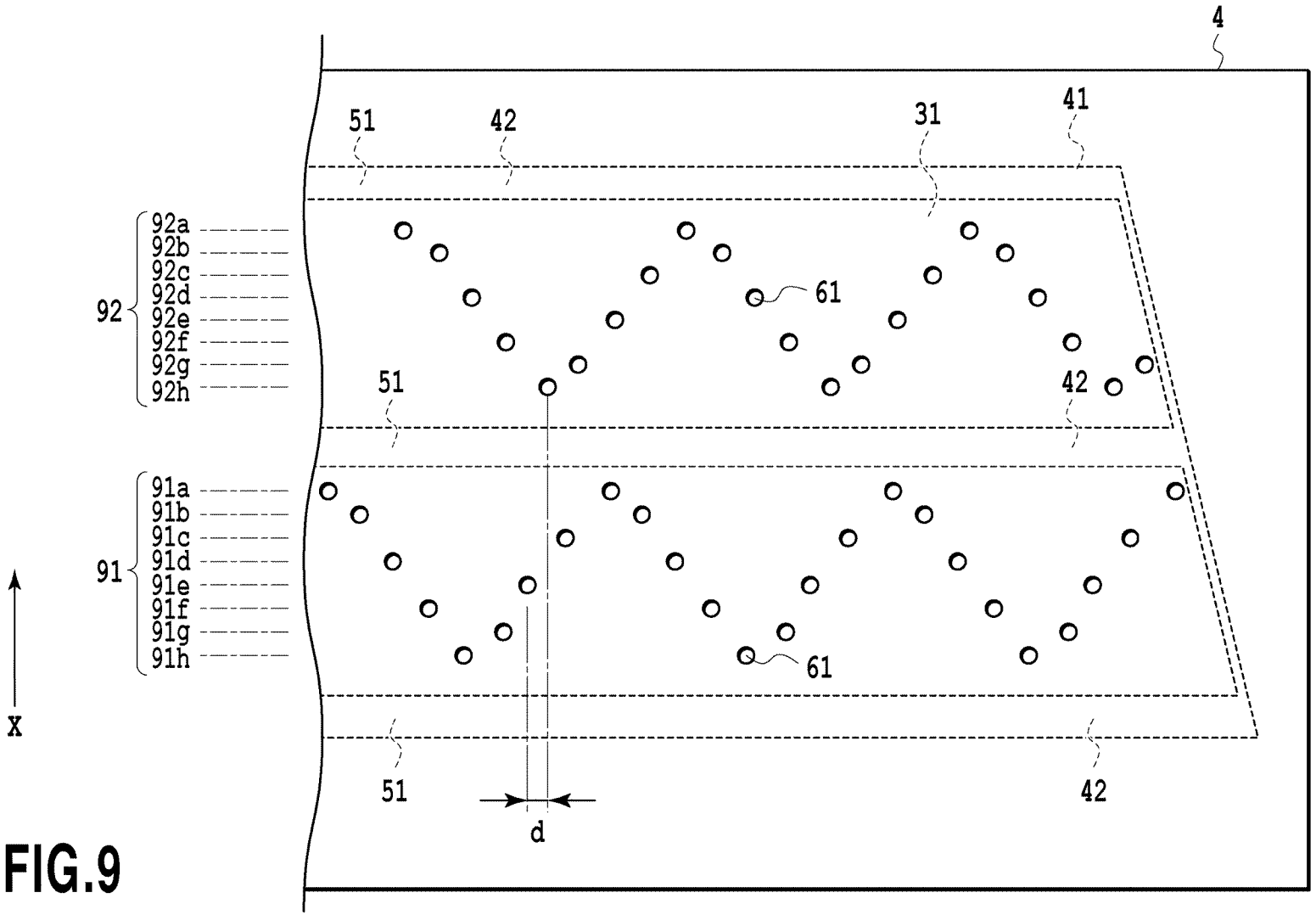
FIG. 9 is a diagram showing the arrangement of ejection openings according to the embodiment of the present invention.

FIG. 9 is a schematic diagram showing an ejection opening surface of the liquid ejection head 2 as viewed from above. An explanation of the configuration similar to that of the first embodiment is omitted. The ejection opening group 91 for previously performing a print is formed to have the zigzag arrangement similar to that of the ejection opening group 81 in the first embodiment, wherein liquid droplets ejected from the adjacent ejection openings come in contact with each other on a print medium.

In the present embodiment, a distance between the adjacent ejection openings in the short direction in the arrangement of the ejection openings in the ejection opening group 92 which performs ejection later (later timing) for printing a same line is made to be similar to that in the ejection opening group 91 such that a time taken for printing one line is a predetermined time or less. The ejection openings groups 91 and the ejection openings groups 92 are arranged such that the ejection opening of the first landing in each of the ejection opening groups 91, 92, that is, the ejection opening positioned in a top in the lower side on a wave shape arrangement, is shifted by a constant amount in the longitudinal direction. The constant amount in the present embodiment is preferably approximately ¼ of a cycle of the wave shape, but an interval in the longitudinal direction between the tops is only required to be "d" or more. Since a cycle of the arrangement of the ejection opening in the present embodiment is 16×600 dpi (42.33 μm)=677 μm, the shift amount is 169 μm that is ¼ of that cycle. That is, the arrangement of the ejection openings in the present embodiment has a substantially same cycle and amplitude in the zigzag arrangement of the ejection opening line and is shifted by ¼ in the longitudinal direction between the ejection opening group 91 and the ejection opening group 92.

In the present embodiment, the top of the wave shape is arranged to be shifted therebetween, but is not necessarily shifted. However, according to the previous review, it is found out that when the liquid ejection head of the same structure is used, the liquid droplet landing shift tends to be easily generated at the similar position. Therefore the arrangement of the ejection openings 61 in which a position of the top in the wave shape is shifted is preferable.

In this way, the present embodiment has the ejection opening arrangement in which even if the shift of the liquid droplet landing position in the longitudinal direction is generated due to the printing of the ejection opening 61 included in the first ejection opening group 91, the streak is not visible and it is possible to suppress the streak due to the bias of the liquid by the time difference between the adjacent liquid droplets.

Third Embodiment

Hereinafter, an explanation will be made of a third embodiment. In the present embodiment, an arrangement of ejection openings included in an ejection opening group 102 (FIG. 10) for ejecting later is made to have a longer cycle of the zigzag shape to an arrangement of ejection openings included in an ejection opening group 101 for ejecting previously.

Figure 10:
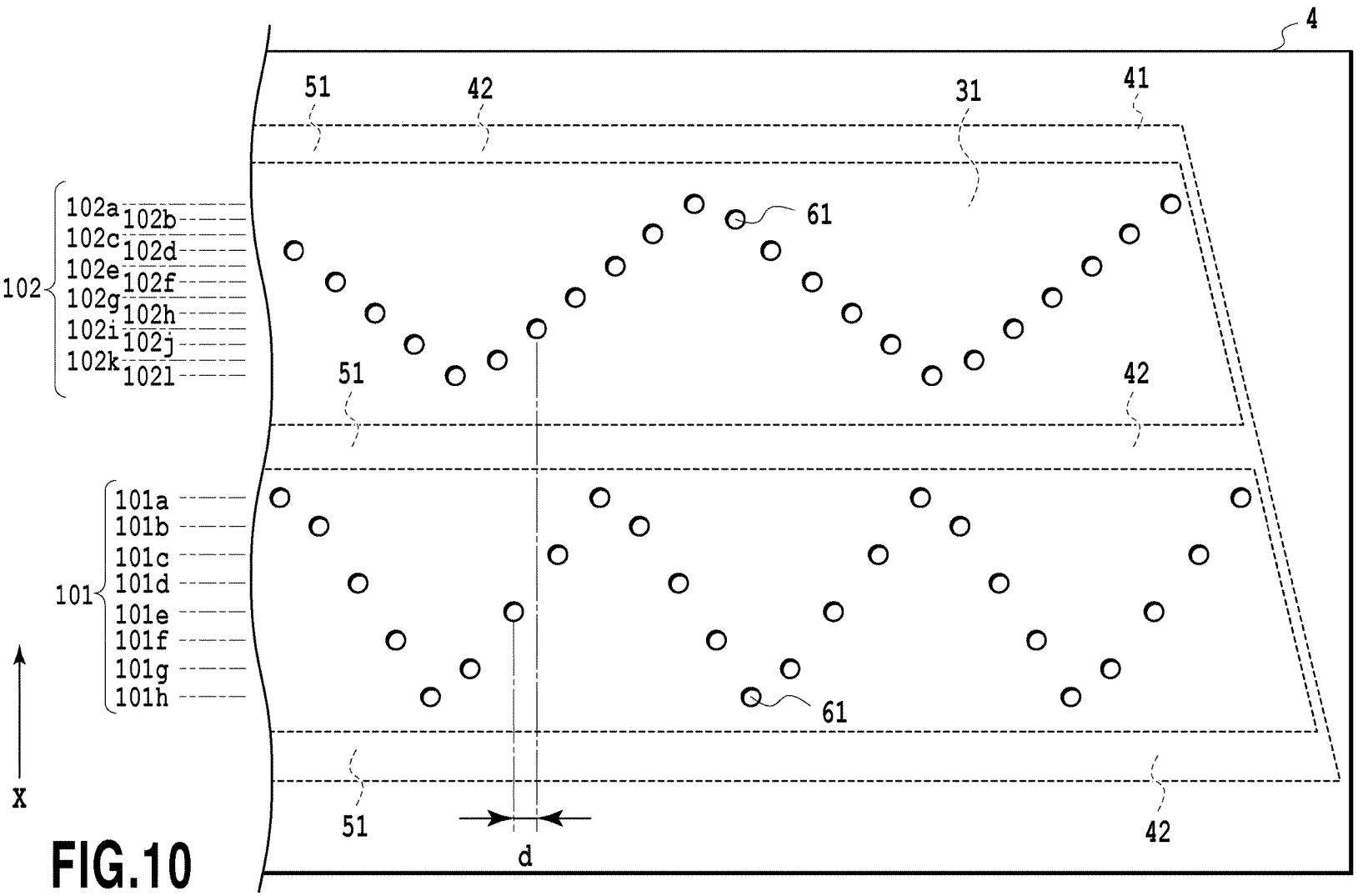
FIG. 10 is a diagram showing the arrangement of ejection openings according to the embodiment of the present invention.

FIG. 10 is a schematic diagram showing the ejection opening surface of the liquid ejection head 2 as viewed from above. An explanation of the configuration similar to that of each of the first embodiment and the second embodiment is omitted. Also in the present embodiment, when one line is formed using the ejection opening group 102 for ejecting previously, the adjacent liquid droplets come in contact with each other. A distance between the adjacent ejection openings in the short direction in the arrangement of the ejection openings in the ejection opening group 102 for ejecting later is made to be similar to that in the ejection opening group 101 such that a time taken for printing one line is a predetermined time or less. The time for the ejection opening group 102 may be similar to that of the ejection opening group 101, but in this case, the respective lengths of the ejection opening groups in the short direction differ from each other. Since the respective lengths of the ejection opening groups 101, 102 are set to the same length in the present embodiment, the maximum value of the time of the adjacent liquid droplet is 1×2/3 ms. In a case of the conveying speed of 0.83 m/s, the adjacent ejection opening is arranged in a position away by a distance of 1×2/3 ms×0.83 m/s=0.55 mm in the short direction. With this arrangement of the ejection openings, the ejection openings result in being arranged in the wave shape, and the ejection openings are arranged such that a cycle of the ejection openings differs between the ejection opening group 101 and the ejection opening group 102.

In this way, according to the present embodiment, even if the shift of the liquid droplet landing position in the longitudinal direction is generated by the ejection opening, the streak is not visible and it is possible to suppress the streak due to the bias of the liquid by the time difference between the adjacent liquid droplets.

Fourth Embodiment

Figure 11:
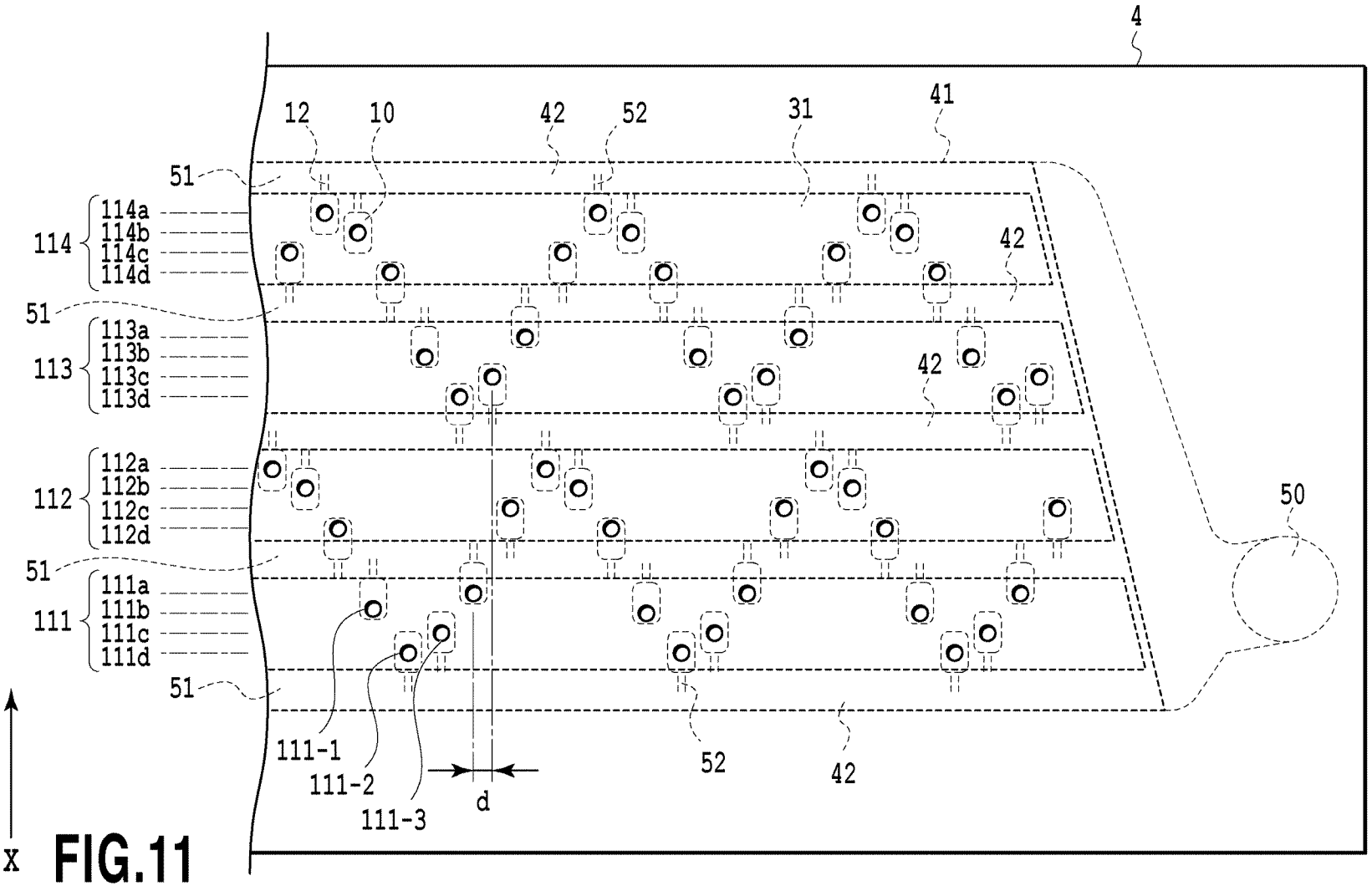
FIG. 11 is a diagram showing the arrangement of ejection openings and flow passages according to the embodiment of the present invention.
Figure 12:
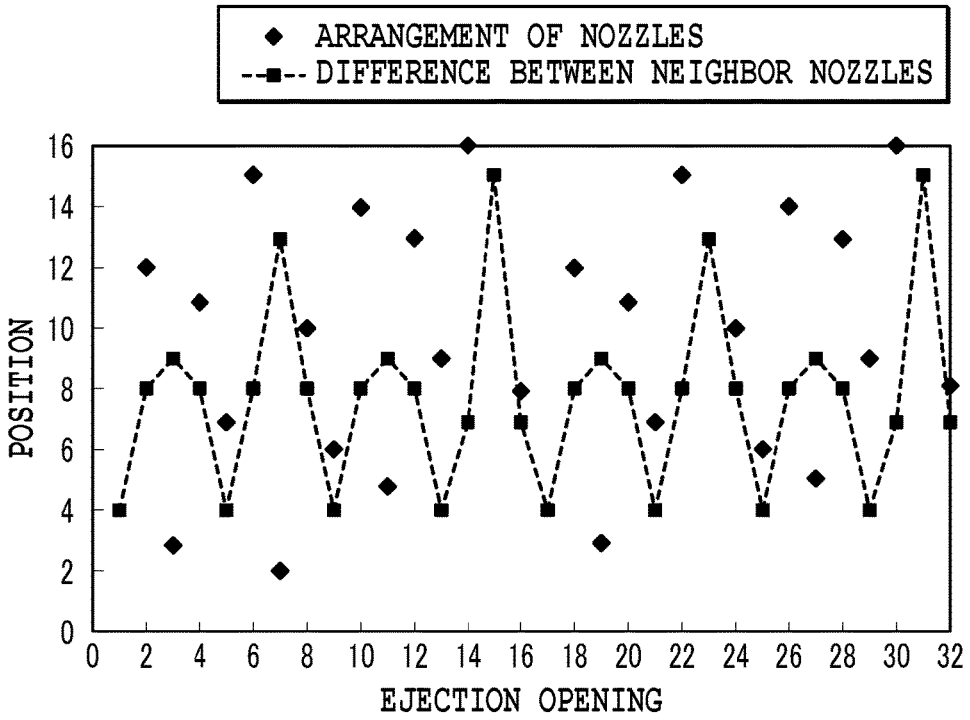
FIG. 12 is a diagram showing a time difference between an ejection opening and an ejection opening adjacent thereto in the conventional liquid ejection head.

Hereinafter, an explanation will be made of a fourth embodiment. The present embodiment is so configured that each of the ejection opening groups is provided with five common liquid flow passages 42 as shown in FIG. 11. Specifically an ejection opening arrangement in one zigzag shape is formed of two sub ejection opening groups (for example, sub ejection opening groups 111, 112), and each of the sub ejection opening groups is configured to receive liquid supply from the two common liquid flow passages 42. Liquids are supplied from the respective common liquid flow passages 42 to the pressure chambers (ejection openings) through individual flow passages 52. Even in a case of the liquid ejection head in which the arrangement of the ejection openings is formed in a zigzag shape as described above, since a distance between each of the ejection openings and the common liquid flow passage 42 can be made shorter as compared with that of the aforementioned embodiments by providing the plurality of liquid flow passages, supply characteristics such as refilling are improved. In addition, the pressure chamber 53 and the aperture 55 can be made short, and a degree of freedom in design is also improved. Further it is possible to suppress a variation in length of the flow passage for connecting the common liquid flow passage 42 and each of the pressure chambers to suppress a variation in liquid characteristics for each ejection opening. Accordingly, as shown in FIG. 11, it is preferable that in the ejection opening arrangement in a zigzag shape extending in the longitudinal direction of the liquid ejection head, the common liquid flow passage 42 is provided in each of one end side and the other end side of the ejection opening arrangement in the short direction, and further, the common liquid flow passage 42 is provided therebetween. The respective common liquid flow passages 42 extend along the longitudinal direction and are provided in parallel.

As shown in FIG. 11, the zigzag-shaped ejection opening arrangement is formed by the ejection opening group 111 and the ejection opening group 112, and likewise, the zigzag-shaped ejection opening arrangement is formed by the ejection opening group 113 and the ejection opening group 114. Each cycle of the respective zigzag-shaped ejection opening lines is the same, and a position of a top portion (inflexion point) in the ejection opening line of each other is shifted from each other in the longitudinal direction. Three lines of the common liquid flow passages 42 are provided to each of the zigzag-shaped ejection opening arrangements, and the liquid flow passage to which the ejection opening groups are adjacent to each other as in the case of the ejection opening group 111 and the ejection opening group 112 is shared. In addition, in the configuration of supplying liquids from the plurality of common liquid flow passages 42 in one ejection opening group (for example, ejection opening group 111), when attention is focused on each ejection opening included in the one ejection opening group, a direction of the individual flow passage 52 from one of the common liquid flow passages 42 to one ejection opening is reversed by 180 degrees to that from the other common liquid flow passage 42. Also in the liquid ejection head provided with the zigzag-shaped ejection opening arrangement by this configuration, it is possible to suppress variations in supply characteristics for each ejection opening. In addition, as similar to each of the aforementioned embodiments, the adjacent liquid droplets come in contact with each other on a print medium in the zigzag-shaped ejection opening arrangement.

The liquid ejection head 2 is provided with 16 ejection opening lines in a direction perpendicular to the longitudinal direction, each ejection opening line provided with ejection openings 61 in a line in the longitudinal direction. In the present embodiment, each of the ejection opening groups is provided with the ejection openings 61 arranged at 300 dpi in the longitudinal direction, and it is possible to form an image at a resolution of 1200 dpi as a whole. That is, an interval "d" between the respective ejection openings of the ejection opening groups in the present embodiment is 21.1 μm. In the present embodiment, the interval "d" alone is shifted, but the shift is not necessarily required, and the printing may be performed at an interval of 300 dpi.

Next, the arrangement of each of the ejection opening groups in the short direction in a case of a resolution of 1200 dpi will be hereinafter explained. A distance between an ejection opening 111-1 and the adjacent ejection opening 111-2 in the ejection opening group 111 in the short direction is set such that a time taken for printing one line is a predetermined value or less. Herein the time of the predetermined value or less differs depending upon a conveying speed of a print medium, but in a case of conveying a roll-shaped print medium at a conveying speed L of (0.83 m/s), it is preferable that the maximum value T (ms) of the time of the adjacent liquid droplet is short. However, there are some cases where such a maximum value T (ms) cannot be structurally made short due to presence of the flow passage or the like, and it is preferably approximately 1 ms. That is, it is preferable that the maximum value T (ms) of the time of the liquid droplet=100/83×L. The adjacent ejection opening is arranged in the short direction such that the maximum value T is below that time. In a case of the conveying speed of 0.83 m/s, the adjacent ejection opening is arranged in a position away by a distance of 1 ms×0.83 m/s=0.83 mm in the short direction. Similarly in regard to the next ejection opening 111-2, a distance between the ejection opening 111-2 and the adjacent ejection opening 111-3 is set such that the time taken when the adjacent ejection opening 111-3 prints one line is a predetermined value or less. This arrangement is resultantly formed such that the ejection opening groups 111, 112 are together used to connect the ejection openings therebetween. By thus arranging the ejection openings, before one ink comes in contact with the other ink to begin to be contracted, the opposite ink comes in contact with the one ink, and the contraction force of the one ink is cancelled out to reduce the bias of the ink.

A distance between the adjacent ejection openings in the short direction in the arrangement of the ejection openings in each of the ejection opening groups 113, 114 for ejecting later is, as similar to that in each of the ejection opening groups 111, 112, set such that a time taken for printing one line is a predetermined time or less. The ejection opening groups 111 and 112, and the ejection opening groups 113 and 114 are arranged such that the ejection opening of the first liquid droplet landing in each of the ejection opening groups, that is, the ejection opening positioned in a top in the lower side on a wave line is shifted from each other by a constant amount in the longitudinal direction. The constant amount in the present embodiment is preferably approximately ¼ of a cycle of a wave, but an interval in the longitudinal direction between the tops is only required to be "d" or more. Since a cycle of the arrangement of the ejection openings in the present embodiment is 16×600 dpi (42.33 μm)=677 μm, the shift amount is 169 μm that is ¼ of that cycle.

The configuration that the arrangement of the ejection opening group in the later part of the printing is similar to that of the ejection opening group in the former part of the printing is the same as in the second embodiment. In addition, also in the present embodiment, the ejection opening in the top of the wave line is arranged to be shifted, but is not necessarily shifted. However, according to the previous review, it is found out that when the liquid ejection head of the same structure is used, the liquid droplet landing shift tends to be easily generated at the similar position. Therefore the arrangement of the ejection opening in which the position of the top in the wave line is shifted is preferable. Since the liquid flow passage comprises a plurality of liquid flow passages in the present embodiment, supply characteristics of the liquid ejection head improve to simplify the design. Further, even if the shift of the liquid droplet landing position in the longitudinal direction is generated by the ejection opening, the streak is not visible and it is possible to suppress the streak due to the bias of the liquid by the time difference between the adjacent liquid droplets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-258886, filed Dec. 22, 2014, which is hereby incorporated by reference herein in its entirety.

What is claimed is:

1. A liquid ejection head comprising:

a first ejection opening group in which a plurality of ejection openings that eject a first kind of liquid onto a print medium are arranged in a first direction; and a second ejection opening group including a plurality of ejection openings that are provided along the first ejection opening group to eject the first kind of liquid onto the print medium, wherein the first ejection opening group is provided upstream of the second ejection opening group with respect to a relative moving direction between the print medium and the liquid ejection head, the plurality of ejection openings included in the first ejection opening group are disposed in the first direction in a zigzag shape in which a distance along the relative moving direction between adjacent ejection openings is equal to or less than 1 ms×a speed of the relative moving, wherein a common liquid flow passage for supplying the liquid to the plurality of ejection openings extends in the first direction, and wherein the common liquid flow passage includes a first common liquid flow passage provided at one end side of the zigzag shape of the ejection openings in the first ejection opening group with respect to a second direction crossing the first direction, the second direction corresponding to the relative moving direction, a second common liquid flow passage provided at the other end side thereof, and a third common liquid flow passage provided along the first common liquid flow passage between the first common liquid flow passage and the second common liquid flow passage.

2. The liquid ejection head according to claim 1, wherein a plurality of ejection openings included in the second ejection opening group are provided in the first direction in a zigzag shape.

3. The liquid ejection head according to claim 2, wherein a cycle of the zigzag shape of the ejection openings in the first ejection opening group is equal to a cycle of the zigzag shape of the ejection openings in the second ejection opening group.

4. The liquid ejection head according to claim 2, wherein a peak of the zigzag shape of the ejection openings in the first ejection opening group is shifted from a peak of the zigzag shape of the ejection openings in the second ejection opening group in the first direction.

5. The liquid ejection head according to claim 1, wherein the ejection openings in the first ejection opening group are shifted from the ejection openings in the second ejection opening group in the first direction.

6. The liquid ejection head according to claim 1, wherein the second common liquid flow passage is communicated with the ejection openings included in the first ejection opening group and the ejection openings included in the second ejection opening group.

7. The liquid ejection head according to claim 1, further comprising:

a first individual flow passage for supplying the liquid to the ejection openings included in the first ejection opening group from the first common liquid flow passage; and a second individual flow passage for supplying the liquid to the ejection openings included in the first ejection opening group from the second common liquid flow passage.

8. The liquid ejection head according to claim 1, further comprising:

a plurality of third individual flow passages for supplying the liquid to the ejection openings included in the first ejection opening group from the third common liquid flow passage, wherein the plurality of third individual flow passages include an individual flow passage extending from the third common liquid flow passage in a direction toward the first common liquid flow passage, and an individual flow passage extending from the third common liquid flow passage in a direction toward the second common liquid flow passage.

9. The liquid ejection head according to claim 1, wherein the liquid ejection head is used in a printing apparatus which conveys the print medium and uses the liquid ejection head to eject liquid onto the print medium, wherein an ejection opening line included in each of the first ejection opening group and the second ejection opening group has a length in accordance with a width of the print medium.

10. The liquid ejection head according to claim 1, wherein the first ejection opening group includes a first ejection opening, a second ejection opening adjacent to the first ejection opening with respect to the first direction, and a third ejection opening adjacent to the second ejection opening at a side opposite to the first ejection opening, and an interval between the first ejection opening and the second ejection opening is substantially equal to an interval between the second ejection opening and the third ejection opening in a second direction crossing the first direction, the second direction corresponding to the relative moving direction.

11. The liquid ejection head according to claim 1, wherein among the plurality of ejection openings included in the first ejection opening group, liquid droplets ejected from ejection openings adjacent to each other contact with each other on the print medium.

* * * * *